US008822393B2

(12) United States Patent
Knotts et al.

(10) Patent No.: US 8,822,393 B2
(45) Date of Patent: Sep. 2, 2014

(54) LUBRICANT FOR PERCUSSION EQUIPMENT

(75) Inventors: Nathan Knotts, San Mateo, CA (US); Allan George Hee, Orinda, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 13/298,631

(22) Filed: Nov. 17, 2011

(65) Prior Publication Data

US 2012/0129745 A1 May 24, 2012

Related U.S. Application Data

(60) Provisional application No. 61/415,751, filed on Nov. 19, 2010.

(51) Int. Cl.
*C10M 129/76* (2006.01)
*C10M 169/04* (2006.01)

(52) U.S. Cl.
CPC ..... *C10M 169/04* (2013.01); *C10N 2230/41* (2013.01); *C01M 2209/084* (2013.01); *C10M 2203/1025* (2013.01); *C01M 169/041* (2013.01); *C10N 2240/06* (2013.01); *C10M 2207/28* (2013.01); *C10N 2230/06* (2013.01); *C10N 2230/42* (2013.01); *C10N 2230/43* (2013.01); *C10M 2203/1006* (2013.01); *C10M 2203/1065* (2013.01); *C10M 2209/102* (2013.01)
USPC ..... 508/469; 508/501

(58) Field of Classification Search
CPC ..... C10M 2203/1006; C10M 2203/1025; C10M 2209/084; C10M 2207/28; C10M 2219/085; C10M 2227/061
USPC ..... 508/469, 501
See application file for complete search history.

(56) References Cited

U.S. PATENT DOCUMENTS

| | | | | |
|---|---|---|---|---|
| 5,798,322 | A * | 8/1998 | Brannen et al. | 508/442 |
| 6,444,622 | B1 | 9/2002 | Balasubramaniam | |
| 6,482,777 | B2 | 11/2002 | Cain | |
| 2006/0019841 | A1 | 1/2006 | Clague | |
| 2007/0298984 | A1 | 12/2007 | Konzman et al. | |
| 2008/0053868 | A1 | 3/2008 | Kleijwegt et al. | |
| 2009/0062163 | A1 * | 3/2009 | Haire et al. | 508/110 |

OTHER PUBLICATIONS

International Preliminary Examination Report from corresponding PCT Application No. PCT/US2011/061242 mailed May 21, 2013.
International Search Report from corresponding PCT Application No. PCT/US2011/061242 mailed May 8, 2012.

* cited by examiner

*Primary Examiner* — Vishal Vasisth
(74) *Attorney, Agent, or Firm* — Susan M. Abernathy; Melissa M. Hayworth; E. Joseph Gess

(57) ABSTRACT

This invention discloses a lubricant suitable for use in percussion equipment. The lubricant comprises a base oil selected from the group consisting of Group I or Group II, blended in a synergistic amount with a gear oil package and a friction modifier. The lubricant exhibits superior wear and superior extreme pressure properties due to the synergistic effect of the gear oil package and the friction modifier. In a preferred embodiment, the gear oil package comprises a polyalkyl methacrylate polymer, and the friction modifier comprises a synthetic ester.

18 Claims, No Drawings

LUBRICANT FOR PERCUSSION EQUIPMENT

This application claims benefit of 61/415,751, filed Nov. 19, 2010.

FIELD OF INVENTION

This application relates to lubricants which comprise a Group I or Group II oil, a gear oil additive package, and synthetic ester, suitable for use in percussion equipment, and a process for preparing such lubricants.

BACKGROUND

Major OEM's for percussion air equipment, such as rock drills, jackhammers and drifters, have published specification requirements for the fluid that should be used in their equipment. One property that the specification requires the lubricant to meet is to be able to lubricate under extreme pressure, or "EP" conditions. The EP properties of the lubricant are defined by the Timken (ASTM D2782) and Falex EP (ASTM D2670) test standards. EP performance is usually increased by increasing the amount of sulfur (inactive and active) as well as phosphorous compounds in the formulation. Friction modifiers might also be used to change the boundary lubrication properties.

Percussion lubricants must demonstrate the characteristics of long equipment life, reliability in wet conditions, protection in wet environments and low inventory cost. Extreme pressure performance withstands heavy shock loads typical of rock drill service, protecting the equipment against rapid wear. The rock drill piston, rifle bar and nut are thus protected. The lubricant clings to lubricated parts and resists being washed away by trace water in the compressed air. Antirust performance protects critical parts from the corrosive action of wet environments. The lubricant should be multi-purpose, useful in hand oiling and for chain drives, minimizing the number of lubricants in the inventory. This lubricant is effective in lubrication of enclosed gears, industrial plain and anti-friction bearings. It demonstrates low odor and low toxicity.

As a general rule, friction modifiers hurt the performance of anti-wear and/or extreme pressure additives. Generally, the anti-wear or extreme pressure additives in lubricants reduce damage by maintaining a layer of lubricant between the moving parts of the equipment. The additives of the lubricant which provide anti-wear or extreme pressure help reduce harmful metal on metal contact. There is a need for lubricants for rock drills which provide a balance between frictional properties and anti-wear/extreme pressure properties. The lubricant of the current application possesses such a synergistic balance.

SUMMARY OF THE INVENTION

This invention discloses a lubricant suitable for use in percussion equipment. The lubricant comprises a base oil selected from the group consisting of Group I or Group II, blended in a synergistic amount with a gear oil package and a friction modifier. The lubricant exhibits superior wear and superior extreme pressure properties due to the synergistic effect of the gear oil package and the friction modifier.

DETAILED DESCRIPTION OF THE INVENTION

Lubricant base oils are generally classified Group I, II, III, IV and V lubricant base oils, and mixtures thereof. The lubricant base oils include synthetic lubricant base oils, such as Fischer-Tropsch derived lubricant base oils, and mixtures of lubricant base oils that are not synthetic, as well as synthetics. The specifications for Lubricant Base Oils defined in the API Interchange Guidelines (API Publication 1509) using sulfur content, saturates content, and viscosity index, are shown below in Table I. In the present invention, Group I and Group II lubricants are preferred.

TABLE I

| Group | Sulfur, ppm | | Saturates, % | VI |
|---|---|---|---|---|
| I | >300 | and/or | <90 | 80-120 |
| II | ≥300 | and | ≥90 | 80-120 |
| III | ≥300 | and | ≥90 | >120 |
| IV | All Polyalphaolefins | | | |
| V | All Stocks Not Included in Groups I-IV | | | |

Facilities that make Group I lubricant base oils typically use solvents to extract the lower viscosity index (VI) components and increase the VI of the crude to the specifications desired. These solvents are typically phenol or furfural. Solvent extraction gives a product with less than 90% saturates and more than 300 ppm sulfur. The majority of the lubricant production in the world is in the Group I category.

Facilities that make Group II lubricant base oils typically employ hydroprocessing such as hydrocracking or severe hydrotreating to increase the VI of the crude oil to the specification value. The use of hydroprocessing typically increases the saturate content above 90 and reduces the sulfur below 300 ppm. Approximately 10% of the lubricant base oil production in the world is in the Group II category, and about 30% of U.S. production is Group II.

Facilities that make Group III lubricant base oils typically employ wax isomerization technology to make very high VI products. Since the starting feed is waxy vacuum gas oil (VGO) or wax which contains all saturates and little sulfur, the Group III products have saturate contents above 90 and sulfur contents below 300 ppm. Fischer-Tropsch is an ideal feed for a wax isomerization process to make Group III lubricant base oils. Only a small fraction of the world's lubricant supply is in the Group III category.

Group IV lubricant base oils are derived by oligomerization of normal alpha olefins and are called poly alpha olefin (PAO) lubricant base oils.

Group V lubricant base oils are all others. This group includes synthetic esters, silicon lubricants, halogenated lubricant base oils and lubricant base oils with VI values below 80. Group V lubricant base oils typically are prepared from petroleum by the same processes used to make Group I and II lubricant base oils, but under less severe conditions.

Synthetic lubricant base oils meet API Interchange Guidelines but are prepared by Fisher-Tropsch synthesis, ethylene oligomerization, normal alpha olefin oligomerization, or oligomerization of olefins boiling below $C_{10}$. For purposes of this application, synthetic lubricant base oils exclude synthetic esters and silicon lubricants.

As noted in the Summary of the Invention, the lubricant of this invention comprises a base oil selected from the group consisting of Group I or Group II, blended in a synergistic amount with a gear oil package and a friction modifier.

The preferred gear oil package employed in this invention exhibits numerous positive features. These are affected by functional characteristics such as pour point and viscosity index. For example, the package is soluble in Group I and Group II base stocks. The package shows excellent thermal and oxidation stability, and excellent compatibility with commonly used seal materials. The gear package demonstrates proven performance in transmissions, exceptional protection and durability under extreme pressure conditions, and superior protection of copper from corrosion. Strong demulsiblity and foam protection, as well as superior storage stability, are also demonstrated.

Typical characteristics of a gear oil package suitable for use in this invention are provided in Table II.

TABLE II

Typical characteristics of an automotive gear oil package suitable for use in this invention

| | |
|---|---|
| Appearance | Clear Amber liquid |
| Viscosity at 100° C. | 10-15 $mm^2/s$ |
| Specific gravity@15.6/15/6° C. | 1.005 |
| Flash point | >80° C. (COC) |
| Composition | Sulfur-phosphorus hydrocarbon |
| Sulfur content | 15-25 wt % |
| Phosphorus content | 0.75-0.1.25 wt % |

The preferred additive pack of this invention comprises a $C_{12}$ through $C_{20}$ polyalkyl methacrylate polymer for use according to the invention as defined above. The additive pack is added to a lubricating oil based on mineral oil such that the polyalkyl methacrylate polymer accounts for 0.1 to 0.3% by weight of the finished lubricating oil. Preferably, the additive pack is added to the lubricating oil based on mineral oil such that the contents of the additive pack account for up to 15% by weight of the finished lubricating oil. Typically, the additive pack is added to the lubricating oil based on mineral oil such that the contents of the additive pack account for 4 to 10% by weight of the finished lubricating oil. Such an additive pack may comprise any oil additive known to a person skilled in the art that does not interfere with the performance of the polyalkyl methacrylate polymer when used accordance with the present invention. Other appropriate additives that may be used in conjunction with the present invention will be evident to the person skilled in the art and include pour point depressants, anti-wear additives, anti-oxidation additives, anti-rust additives, dispersants, boronated dispersants, viscosity index improvers, detergents and friction modifiers.

Viscosity Index Improvers

TABLE III viscosity ranges for industrial fluid lubricants at different ISO grades

| Viscosity System | Mid-Point Viscosity, cSt | Kinematic Viscosity Limits, ($mm^2/s$) at 40.0° C. | |
|---|---|---|---|
| Grade ID | ($mm^2/s$) at 40.0° C. | min. | max |
| ISO VG 32 | 32 | 28.8 | 35.2 |
| ISO VG 46 | 46 | 41.4 | 50.6 |
| ISO VG 68 | 68 | 61.2 | 74.8 |
| ISO VG 100 | 100 | 90.0 | 110 |
| ISO VG 150 | 150 | 135 | 165 |

Viscosity index improvers impart high and low temperature operability to the lubricating oil and permit it to remain relatively viscous at elevated temperatures and also exhibit acceptable viscosity or fluidity at low temperatures. Viscosity index improvers are generally high molecular weight hydrocarbon polymers including polyesters. The viscosity index improvers may also be derivatized to include other properties or functions, such as the addition of dispersancy properties. These oil soluble viscosity modifying polymers will generally have number average molecular weights of from 103 to 106, preferably 104 to 106, as determined by gel permeation chromatography or osmometry.

The viscosity index improvers useful herein can include polymethacrylate-based ones, olefin copolymer-based ones, (e.g., isobutylene-based and ethylene-propylene copolymer based ones), polyalkyl styrene-based ones, hydrogenated styrene-butadiene copolymer-based ones, and styrene-maleic anhydride ester copolymer-based ones.

Representative examples of suitable viscosity index improvers are found in U.S. Pat. Nos. 5,075,383; 5,102,566; 5,139,688; 5,238,588; and 6,107,257.

Pour Point Depressants

Pour point depressants are used to improve low temperature properties of oil-based compositions. See, for example, page 8 of "Lubricant Additives" by C. V. Smalheer and R. Kennedy Smith (Lezius Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and ter-polymers of dialkylfumarates, vinyl esters of fatty acids and alkyl vinyl ethers. Pour point depressants are described in U.S. Pat. Nos. 2,387,501; 2,015,748; 2,655,479; 1,815,022; 2,191,498; 2,666,746; 2,721,877; 2,721,878; and 3,250,715.

Dispersants

Dispersants used in the present invention may be ash-producing or ashless. Suitable dispersants for use herein can typically comprise amine, alcohol, amide, or ester polar moieties attached to the polymer backbone via a bridging group. The dispersant may be, for example, selected from oil-soluble salts, esters, amino-esters, amides, imides, and oxazolines along chain hydrocarbon substituted mono- and dicarboxylic acids or their anhydrides; thiocarboxylate derivatives of chain hydrocarbons; long chain aliphatic hydrocarbons having a polyamine attached directly thereto; and Mannich condensation products formed by condensing a long chain substituted phenol with formaldehyde and polyalkylene polyamine, and Koch reaction products. The long chain aliphatic hydrocarbons can be polymers such as polyalkylenes, including, for example, polyisobutylene, polyethylene, polypropylene, and copolymers thereof and/or copolymers with other alpha-olefins. Typical PIB molecular weights useful herein can range from about 950 to 6000.

Representative examples of dispersants suitable for use in the present invention are found in U.S. Pat. Nos. 5,075,383; 5,139,688; 5,238,588; and 6,107,257. Additional representative examples are found in Patent Application Publication No 2001/0036906A1.

Detergents

A detergent is an additive that reduces the formation of piston deposits, for example high-temperature varnish and lacquer deposits, in engines. Detergents typically possess acid-neutralizing properties and are capable of keeping finely divided solids in suspension. Metal detergents are used preferably for improving the acid-neutralizing properties, high-temperature detergency, and anti-wear properties of the resulting lubricating oil composition.

Detergents used herein may be any detergent used in lubricating oil formulations, and may be of the ash-producing or ashless variety. Detergents suitable for use in the present invention include all of the detergents customarily used in lubricating oils, including metal detergents. Specific examples of metal detergents are those selected from alkali metal or alkaline earth metal sulfonates, alkali metal or alkaline earth metal phenates, and alkali metal or alkaline earth metal salicylates. In an embodiment, the lubricating oil formulation is essentially free of sulfurized phenate detergent.

Representative examples of suitable detergents useful in the present invention are found in U.S. Pat. No. 6,008,166. Additional representative examples of suitable detergents are found in U.S. Patent Application Nos. 2002/0142922A1, 2002/0004069A1, and 2002/0147115A1. The disclosures of the afore-mentioned references are incorporated by reference herein.

Antioxidants

Useful antioxidant materials include oil soluble phenolic compounds, oil soluble sulfurized organic compounds, oil soluble amine antioxidants, oil soluble organo borates, oil soluble organo phosphites, oil soluble organo phosphates, oil soluble organo dithiophosphates and mixtures thereof. Such antioxidants can be metal free (that is, free of metals which are capable of generating sulfated ash), and therefore are most preferably ashless (having a sulfated ash value not greater than 1 wt. % SASH, as determined by ASTM D874).

Representative examples of suitable antioxidants useful in the present invention are found in U.S. Pat. No. 5,102,566. Additional representative examples of suitable antioxidants useful in the present invention are found in U.S. Patent Application Publication No. 2001/0012 A1. The disclosures of the afore-mentioned references are incorporated by reference herein.

Friction Modifiers

Friction modifiers serve to impart the proper friction characteristics to lubricating oil compositions.

Friction modifiers include such compounds as aliphatic amines or ethoxylated aliphatic amines, aliphatic fatty acid amines, aliphatic carboxylic acids, aliphatic carboxylic esters of polyols such as glycerol esters of fatty acid as exemplified by glycerol phenate, aliphatic carboxylic ester-amides, aliphatic phosphonates, aliphatic phosphates, aliphatic thiophosphonates, aliphatic thiophosphates, etc., wherein the aliphatic group usually contains above about eight carbon atoms so as to render the compound suitably oil soluble. Also suitable are aliphatic substituted succinimides formed by reacting one or more aliphatic succinic acids or anhydrides with ammonia. Additionally suited for use in the present invention are friction modifiers containing molybdenum.

Representative examples of molybdenum-containing friction modifiers include those found in U.S. Pat. No. 5,650,381; RE37,363E; U.S. Pat. Nos. 5,628,802; 4,889,647; 5,412,130; 4,786,423; 4,812,246; 5,137,647; 5,364,545; 5,840,672; 5,925,600; 5,962,377; 5,994,977; 6,017,858; 6,150,309; 6,174,842; 6,187,723; 6,268,316; European Patent Nos. EP 222 143 E1; EP 281 992 E1; EP 719314 E1; EP 719315 E1; EP 874040 A1; EP 892037 A1; EP 931 827 A1; EP 1 041 134 A1; EP 1 041 135 A1; EP 1 087 008 A1; EP 1 088 882 A1; EP; Japanese Patent No. JP 11035961; and International Publication Nos. WO 95/07965; WO 00/08120; WO 00/71649.

Representative examples of suitable friction modifiers are found in U.S. Pat. Nos. 3,933,659; 4,105,571; 3,779,928; 3,778,375; 3,852,205; 3,879,306; 3,932,290; 3,932,290; 4,028,258; 4,344,853; 5,102,566; 6,103,674; 6,174,842; 6,500,786; 6,500,786; and 6,509,303. Additional representative examples of suitable friction modifiers are found in U.S. Patent Application Publication No. 2002/0137636 A 1.

Particularly desirable for use as a friction modifier in one embodiment of this application are synthetic esters. These include Lubrizol Syn-esther™ GY-25, a high molecular weight polymerized ester designed to totally replace or substantially reduce the amount of extreme pressure additives such as chlorine or sulfur in industrial oils and coolants. In straight oils, maximum effectiveness is achieved when such an ester is formulated with a phosphorus containing additive or an oil soluble active or inactive sulfur compound. When using these esters, the amount of active sulfur can often be reduced by about 50-75%. In soluble oils and semi-synthetics, no extreme pressure additives, other than these esters is required.

Other synthetic esters which are also suitable include ADDCO™ EP-50, SynEster™ SE-110, Syn-Ester™ SE-115, Syn-Ester™ GY-HTO, Syn-Ester™ GY-56, Syn-Ester™ GY-500, Syn-Ester™ GY-10 and Syn-Ester™ GY-15.

These polymeric esters are ashless and burn off cleanly. Due to their low degree of unsaturation, these synthetic esters do not cause staining and have excellent thermal, oxidative and hydrolytic stability. They are ideally suited for use in straight oils where performance at high temperature is required. Synthetic esters tend to be soluble in naphthenic oils Solubility in paraffinic oils depends on the particularly oil selected, ester concentration, oils viscosity and degree of hydrotreatment. It is an excellent replacement for lard and related lubricity additives. Synthetic esters such as Syn-Ester™ GY-25 are saturated, branched chain polymers. They are expected to be less susceptible to biological attack than conventional fatty additives. Syn-ester™ GY-25 contains no chlorine, sulfur or phosphorus.

TABLE IV

Typical properties of synthetic esters-

| | | |
|---|---|---|
| Typical Properties | Appearance | Hazy[1], Light Amber |
| | Specific Gravity @ 15.6° C. | 1.00 |
| | Weight/Gallon (lb) @ 15.6° C. | 8.33 |
| | Acid Number (mg KOH/g) | 20 |
| | Viscosity (cSt) @ 100° C. | 244 |
| | Viscosity Index | 203 |
| | Iodine Value | <2 |
| | Solubility | Complete in all naphthenic oils and most paraffinic oils |

[1]Haze is a result of the titer of the base acid and does not indicate insolubility or particulate matter. SYN-ESTER ™ GY-25 becomes clear upon heating to 32° C. The product is clear in oils at normal treatment levels at ambient temperature.

In addition to friction modifiers, tackifiers, may be added also be added in small amounts to increase the stickiness of the lubricant.

The Falex Pin and Vee Block method (ASTM D 2670-95) is the standard Test method of measuring wear properties of fluid lubricants. It is summarized as follows:

A rotating steel journal is run against two stationary steel V-blocks immersed in the lubricant sample. Load is applied to the V-blocks and maintained by a ratchet mechanism. Wear is determined and recorded as the number of teeth of the ratchet mechanism advanced to maintain load constant during the prescribed testing time. This test method may be used to determine wear obtained with fluid lubricants under the prescribed test conditions.

The Timken method (ASTM D 2782-02) is the standard Test method for measuring Extreme Pressure properties of lubricating fluids. The tester is operated with a steel cup rotating against a steel test block. The rotating speed is 123.71±0.77 m/min (405.88±2.54 ft/min) which is equivalent to spindle speed of 800±5 rpm. Fluid samples are pre-heated to 37.8±2.8 C (100±5 F) before starting the test.

Two determinations are made: the minimum load (score value) that will rupture the lubricant film being tested between the rotating cup and the stationary block and cause scoring or seizure; and the maximum load (OK value) at which the rotating cup will not rupture the lubricant film and cause scoring or seizure between the rotating cup and the stationary block.

Table V discusses the standard characteristics of industrial fluid lubricants at different ISO grades. Such lubricants include rock drill oils.

TABLE V

Standard characteristics of industrial fluid lubricants at different ISO grades

| ISO grade | 46 | 100 | 150 | 220 | 320 |
|---|---|---|---|---|---|
| API Gravity | 32.2 | 31.5 | 29.8 | 29.8 | 26.7 |
| Viscosity, Kinematic | | | | | |
| cSt at 40° C. | 43.7 | 95 | 143 | 209 | 304 |
| cSt at 100° C. | 6.5 | 10.9 | 14.4 | 18.5 | 23.5 |
| Viscosity, Saybolt | | | | | |
| SUS at 100° F. | 226 | 495 | 750 | 1101 | 1616 |
| SUS at 210° F | 48 | 64 | 77 | 94 | 17 |
| Viscosity Index | 98 | 98 | 99 | 98 | 97 |
| Flash Point, ° C. (° F.) | 210(410) | 230(446) | 260(500) | 260(500) | 260(500) |
| Pour Point, ° C. (° F.) | −24(−11) | −24(−11) | −24(−11) | −21(−6) | −18(0) |
| Timken OK Load, lb | 60 | 65 | 65 | 70 | 75 |
| Falex EP Fail Load, lb | 3200 | 3200 | 3200 | 3200 | 3200 |
| Steam Emulsion Number | >1200 | >1200 | >1200 | >1200 | >1200 |

EXAMPLES

TABLE VI

Experimental results

| | | ISO 46 | ISO 46 | ISO 46 | ISO 46 | ISO 46 | ISO 46 | ISO 46 | ISO 46 |
|---|---|---|---|---|---|---|---|---|---|
| 100Rbase oil | Wt % | 8.56 | 7.94 | 7.31 | | | 5.37 | 5.89 | |
| 220Rbase oil | Wt % | 89.09 | 89.41 | 89.74 | | | 91.88 | 91.36 | |
| 150Rbase oil | Wt % | | | | 75.62 | 74.55 | | | 73.7 |
| 600Rbase oil | Wt % | | | | 21.63 | 22.7 | | | 23.55 |
| Hitec 388(gear package) | Wt % | 1.3 | 1.6 | 1.9 | 1.6 | 1.6 | 1.60 | 1.6 | 1.6 |
| Paratac(tackifier) | Wt % | 1.0 | 1.0 | 1.0 | 1.0 | 1.0 | 1.00 | 1.0 | 1.0 |
| Syn-Ester GY-25(friction modifier-synthetic ester) | Wt % | | | | | 0.1 | 0.10 | 0.2 | 0.2 |
| Syn-Ester SE 110(friction modifier-synthetic ester) | Wt % | | | | 0.1 | | | | |
| Viscoplex 1-604(viscosity improver) | Wt % | 0.05 | 0.05 | 0.05 | 0.05 | 0.05 | 0.05 | 0.05 | 0.05 |
| Target Viscosity @40 C. | Wt % | 43.7 | 43.7 | 43.7 | 43.7 | | 43.7 | 43.6 | 43.6 |
| KV @ 40 | Min 37.000 | 43.96 | 44.19 | 44.33 | 43.68 | 44.27 | 43.99 | 44.15 | 44.28 |
| KV @ 100 | Min 6.000 | 6.932 | 6.995 | 7.006 | 7.095 | 7.152 | 7.104 | 7.17 | 7.22 |
| VI | Min 90.000 | 115 | 116 | 116 | 122 | | 121 | 123 | 125 |
| Timken Results | | | | | | | | | |
| OK loads, lbs | 30 | 65 | | | | | | 70 | |
| | | | | | | | | | Repeat |
| Falex EP Load, lb | 2000 | | | | | | | | |
| Torque spike no pin shear | | 1327 | | | | | | 2078 | |
| Load @ test end | | 4500 | 1935 | 1831 | 2258 | 3126 | 2800 | 4500 | 2740 | 2596 |
| Pin Sheared | | No | Yes | Yes | Yes | Yes | Yes | No maxtorque @ 3834 | Yes | Yes |

Discussion of Experimental Results Set Forth in Table VI

Applicants discovered, while trying to meet the requirements of the EP tests during development of a new rock drill lubricant, a novel result. It involved the addition of a small amount of a synthetic ester (additive class-friction modifier). The addition of synthetic ester or friction modifier boosted the EP properties of the rock drill. Even though friction modifiers have been used in other commercial formulas to increase the EP properties it appears that a synergistic point as been found during development of rock drill oil using the automotive gear package with the typical characteristics of Table II with a synthetic ester having the characteristics disclosed in Table IV (e.g. Lubrizol Syn-Ester GY-25, a friction modifier) at a treat rate of 0.1 wt % (see Table VI). In Table VI the formulation results for Falex EP test shows the greatest response to the addition of the friction modifier. Varying amounts of the gear oil package of Table II (e.g. Hitec 388) gave mixed results at 1.3 wt %, where the pin did not shear but resulted in a torque spike well below 2000 lbs which is the minimum for the test specification. The result is due to the V-block in the test apparatus welding to the pin and then breaking free without causing the pin to shear. As the treat rate was increased to 1.6 wt % the results improved but was still below the specification, and when 1.9 wt % was tested it started to decrease so the benefit from the base additive package was reached. The addition of different friction modifiers was also investigated it was observed that the addition of treat rates in the 0.1 wt range showed improved Falex EP results. The greatest improvement came with the treat rate of Synester GF-25 at 0.1 wt %.

The invention claimed is:

1. A lubricant comprising a base oil selected from the group consisting of Group I or Group II, blended with a gear oil package comprising sulfur-phosphorus hydrocarbons comprising from 15-25 wt % sulfur and from 0.75-1.25 wt % phosphorus and with a synthetic ester friction modifier, wherein the gear oil package is present in an amount of 1.3 to 1.9% by weight of the lubricant and the friction modifier is present in an amount of 0.1 to 0.2% by weight of the lubricant, and the lubricant is a percussion equipment lubricant.

2. The lubricant of claim 1, wherein the lubricant further comprises a polyalkyl methacrylate polymer.

3. The lubricant of claim 2, wherein the polyalkyl group in the polyalkyl methacrylate polymer is in the range from C12 through C20.

4. The lubricant of claim 1, wherein the synthetic ester is a saturated, branched chained polymer.

5. The lubricant of claim 4, wherein the synthetic ester is free of chlorine, sulfur and phosphorus.

6. The lubricant of claim 1, wherein the lubricant exhibits antiwear properties of at least 2000 lbs. as measured by the Falex EP load test.

7. The lubricant of claim 1, wherein the lubricant exhibits extreme pressure properties of at least 30 lbs. as measured by the Timken test.

8. The lubricant of claim 2, wherein the polyalkyl methacrylate polymer is present in an amount from 0.1 to 0.3 wt %.

9. The lubricant of claim 1, wherein the synthetic ester friction modifier is present in an amount of 0.2 wt %.

10. The lubricant of claim 4, wherein the synthetic ester is soluble in naphthenic oils.

11. The lubricant of claim 4, wherein the synthetic ester is soluble in paraffinic oils.

12. The lubricant of claim 6, wherein the Falex load is greater than 3000 lbs.

13. The lubricant of claim 7, wherein the Timken OK load is greater than 60 lbs.

14. The lubricant of claim 1, where the synthetic ester friction modifier is present in amount of 0.1 wt %.

15. A process of preparing a lubricant suitable for use in percussion equipment, said process comprising adding a) a gear oil package comprising sulfur-phosphorus hydrocarbons comprising from 15-25 wt % sulfur and from 0.75-1.25 wt % phosphorus and b) a synthetic ester friction modifier to a Group II oil, wherein the gear oil package is added in an amount of 1.3 to 1.9% by weight of the lubricant and the synthetic ester friction modifier is added in an amount of 0.1 to 0.2% by weight of the lubricant.

16. A lubricant comprising a) a Group II base oil; b) a gear oil package comprising sulfur-phosphorus hydrocarbons comprising from 15-25 wt % sulfur and from 0.75-1.25 wt % phosphorus; and c) a synthetic ester friction modifier, wherein the gear oil package is present in an amount of 1.3 to 1.9% by weight of the lubricant and the friction modifier is present in an amount of 0.1 to 0.2% by weight of the lubricant and wherein the lubricant has a VI of 115 to 125, and the lubricant is a percussion equipment lubricant.

17. The lubricant of claim 16, where the synthetic ester friction modifier is present in amount of 0.1% by weight.

18. The lubricant of claim 16, wherein the lubricant further comprises a tackifier.

* * * * *